US005118175A

United States Patent [19]

Costello

[11] Patent Number: 5,118,175

[45] Date of Patent: Jun. 2, 1992

[54] GUN LOCKER

[75] Inventor: Stephen P. Costello, Fallbrook, Calif.

[73] Assignee: Costello Manufacturing, Inc., Los Angeles, Calif.

[21] Appl. No.: 642,900

[22] Filed: Jan. 18, 1991

[51] Int. Cl.[5] ..... A47B 67/02

[52] U.S. Cl. ..... 312/242; 312/271; 206/317; 224/912

[58] Field of Search ..... 312/319, 328, 204, 242, 312/271, 274; 206/45.13, 387, 317; 224/911, 912

[56] References Cited

U.S. PATENT DOCUMENTS

| | | | |
|---|---|---|---|
| 1,007,113 | 10/1911 | Kazian | 206/45.73 |
| 1,557,339 | 10/1925 | Sander | 224/912 |
| 3,464,606 | 9/1969 | Nordeen | 312/242 |
| 4,155,608 | 5/1979 | Orlewicz | 312/204 |
| 4,309,065 | 1/1982 | Pappas | 312/319 |
| 4,800,822 | 1/1989 | Adkins | 312/319 |
| 4,936,038 | 7/1990 | Johnson et al. | 312/204 |
| 5,056,342 | 10/1991 | Prinz | 224/912 |

*Primary Examiner*—Gerald A. Anderson
*Attorney, Agent, or Firm*—Harvey S. Hertz

[57] ABSTRACT

A gun locker includes a housing having a rear wall and a front door. The door is pivotally opened. A locking mechanism enables the door to be opened for access to the interior of the housing. A gun holster is positioned in the housing. The holster is formed of a main gun cavity and a pair of end straps. The plane of the gun cavity and the end straps are perpendicular to the plane of the door when the door is opened. One of the straps is secured between the rear edge of the holster gun cavity and the rear wall of the enclosure and the other end strap is secured between the front edge of the holster gun cavity and the interior surface of the door.

3 Claims, 2 Drawing Sheets

GUN LOCKER

BACKGROUND OF THE INVENTION

1. Field of the Invention

The field to which the invention pertains includes the field of gun lockers, and more particularly, to a locker for securing a gun when not in use and positioning a gun for ready access when a locker is open.

2. Description of the Prior Art

Gun lockers are relatively well-known. In view of the danger of a gun when not in a secure position and not in use, lockers are used to prevent children and other individuals who are not adequately trained in a handling of a gun, from gaining access to a loaded weapon and discharging the weapon.

In U.S. Pat. No. 4,309,065 a security enclosure for hand guns contains a door which is pivotally attached to one side thereof. Within the enclosure is holster for holding the gun. The holster is pivotally mounted to the inside of the box and adapted to swing outwardly 90 degrees as the doors open so as to present the handle of the gun to the person opening the door. However, when the gun swings out, the axis of the gun barrel remains in a vertical position and it is not the ideal position for removing the gun from the holster.

In U.S. Pat. No. 3,464,606, a pistol locker has a bottom wall which comprises a pivoted closure plate 28. A U-shaped clip 40 releasably supports a pistol mounted in the interior surface of a closure plate 28. After the locker has been opened, the gun which is attached to the closure plate 28 is ready for quick access. However, in this patent the position of the gun is not in the most desirable position for ready availability.

U.S. Pat. No. 4,800,822 illustrates a gun locker having an ejectable drawer. Upon opening a door, the ejectable drawer is forced outwardly to present a firearm therein for grasping.

U.S. Pat. No. 4,155,608 illustrates an additional type of gun locker.

SUMMARY OF THE INVENTION

A gun locker comprises a housing defining an enclosure having a rear wall and a front door secured to the front end thereof. The door is pivotally opened. A locking mechanism enables the door to be opened for access to the interior of the housing. A gun holster is positioned in the housing, the holster being formed of a main gun cavity and a pair of end straps. The plane of the gun cavity and the end straps are perpendicular to the plane of the door when the door is opened. One of the straps is secured between the rear edge of the holster gun cavity and rear wall of the enclosure and the other end strap is secured between the front edge of the holster gun cavity and interior surface of the door. The gun cavity is rotatable when the door is moved between a closed and open position, so that the axis of the barrel of the gun insertable in the cavity would rotate from a generally vertical position to a position wherein the axis is an acute angle with respect to the vertical plane when the door is open.

The advantages of this invention, both as to its description and mode of operation, may best be understood by reference to the following detailed description taken in connection with the accompanying drawings in which like reference numerals designate like parts throughout the figures.

DESCRIPTION OF THE PREFERRED EMBODIMENT

Figure 1:
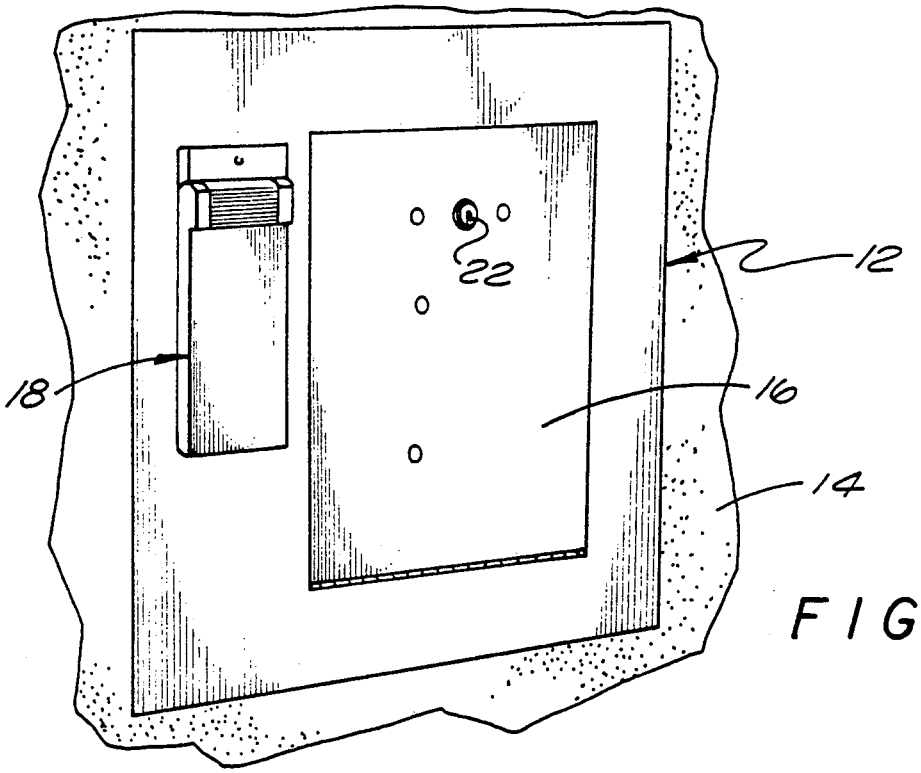
FIG. 1 is a perspective view of the gun locker with the locker door in a closed position.

Referring now to the drawings that are shown in FIG. 1 a gun locker 12 shown flush-mounted within a wall 14. Alternatively, it should be understood that a gun locker could be mounted on the wall as well. The locker contains a door 16 which can be opened by an electronic key pad 18 shown covered in FIG. 1 or by a back-up key access 22.

Figure 2:
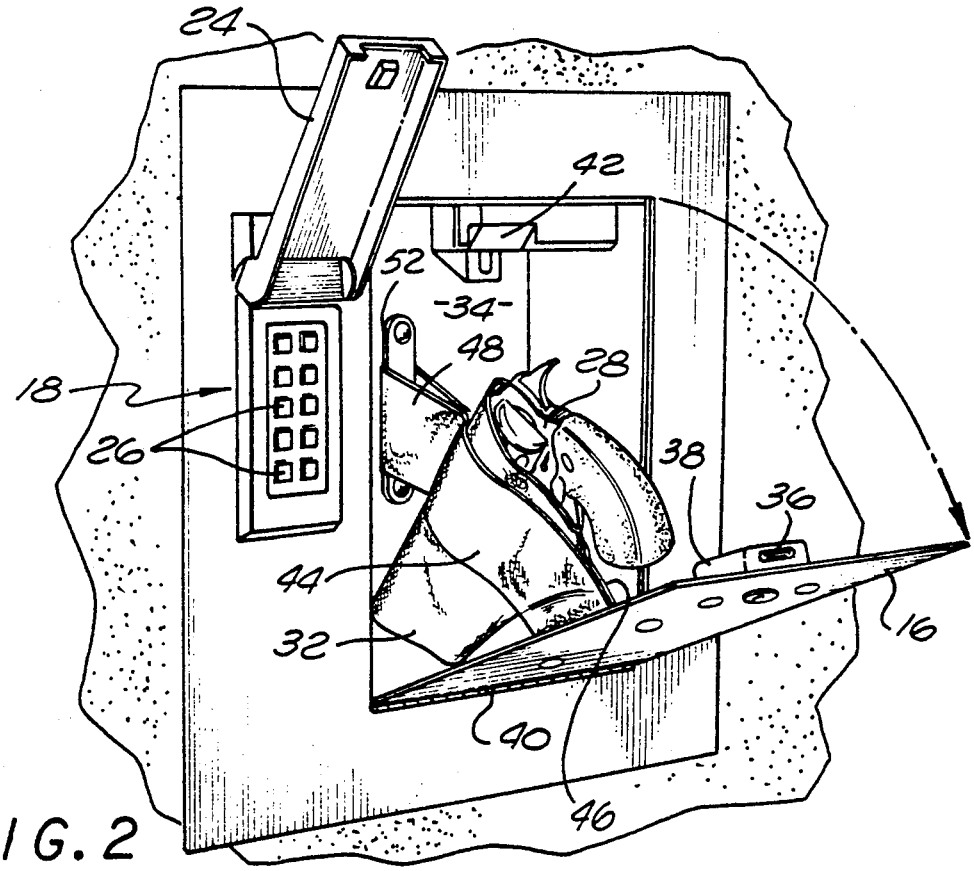
FIG. 2 is a perspective view of the gun locker with the locker door in an open position.

As illustrated in FIG. 2, the key, pad cover 24 is raised enabling access to the key pad buttons 26. The key pad 18 is conventional and forms no part of the invention. With the door 16 open, access can be had to a gun 28 mounted in a holster 32. The holster is secured between the rear wall 34 of the locker and the interior surface of the door 16.

The door 16 is open by inserting the correct combination into the electronic key pad 18, thus retracting a bolt 36 into the lock mechanism 38. The door 16 pivots outwardly about the lower horizontal door hinge 40. It should be noted that a bolt retaining plate 42 is formed in the interior of the locker and together with the bolt 36 keeps the door 16 in a normally locked position. Withdrawal of the bolt 36 automatically opens the door 16 (as will be explained hereinafter) so that the gun 28 is in a position shown in FIG. 2 and at a convenient angle for removing the gun from the holster 32 and using it if needed.

A pair of straps 44 and 46 are integrally sewn to opposite sides of the holster and the ends thereof extend beyond the holster. The interior end of the straps 44 and 46 form a loop 48 which is attached to a flange plate 52 secured to the interior surface of rear wall 34 of the locker 12.

Figure 3:
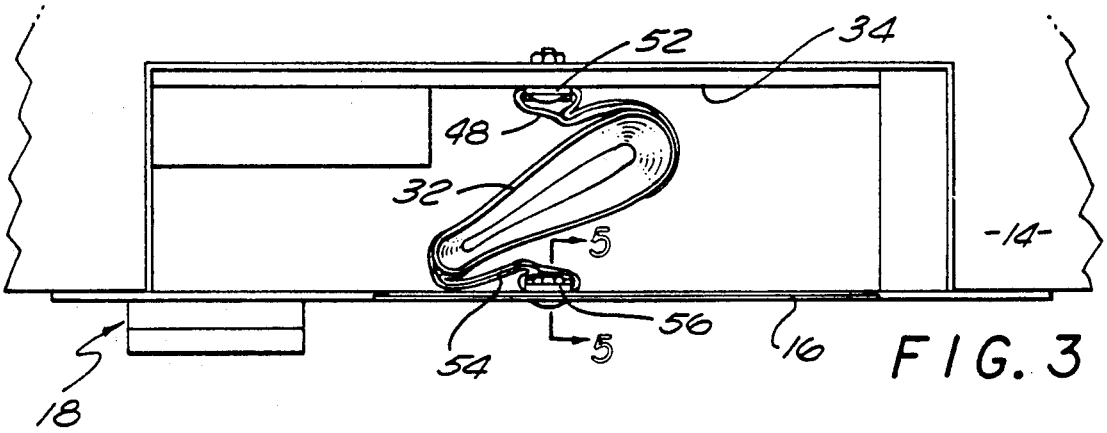
FIG. 3 is a top plan view of the interior of the locker with the door closed.
Figure 4:
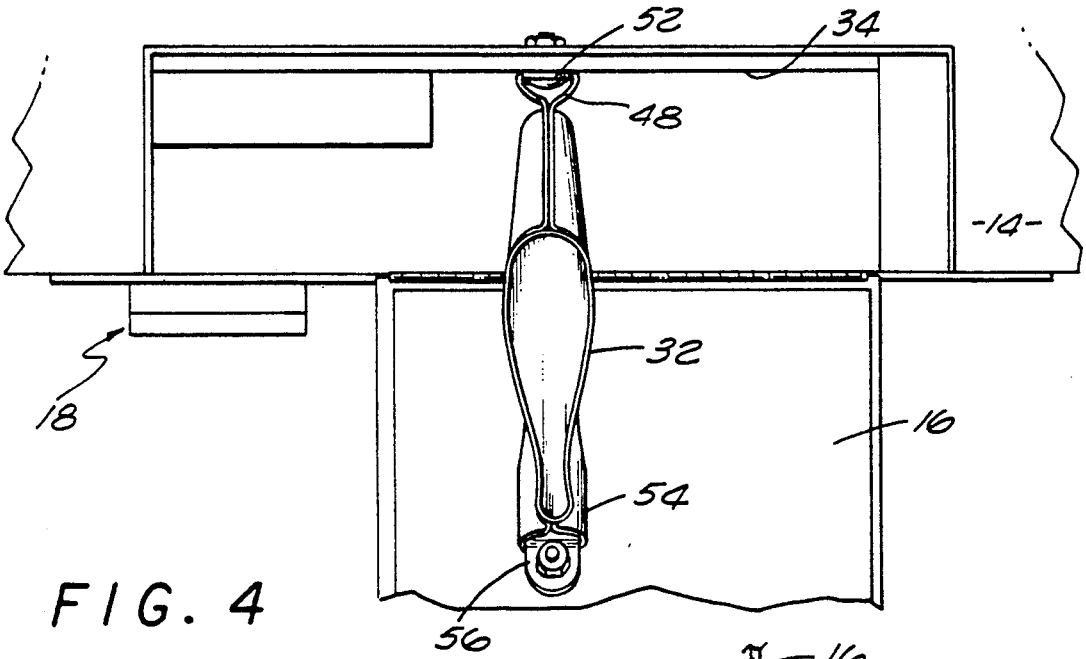
FIG. 4 is a top plan view of the interior of the locker with a door open.
Figure 5:
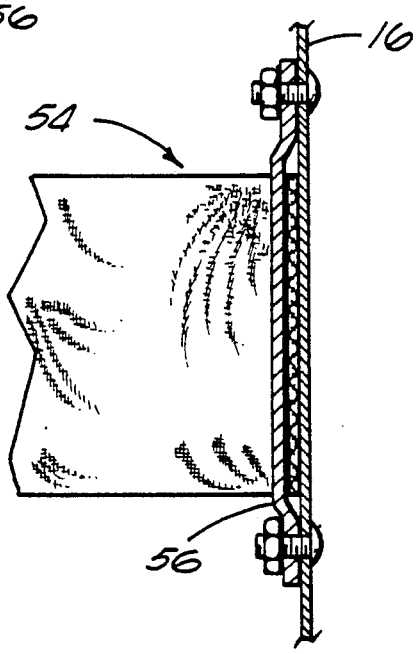
FIG 5 is a cross-sectional view taken along the line 5—5 of FIG. 3.

As can be seen in FIGS. 3 and 4, the other ends of the straps 44 and 46 form a second loop 54 which is attached to a flange plate 56 mounted on the interior of the door 16 and which is similar to the rear wall flange plate 52.

When the door 16 is in a closed position as shown in FIG. 3, the plane of the gun holster 32 at an angle with respect to the plane of the door 16. A gun, such as the gun 28 illustrated in FIG. 2, which will be mounted in the holster 32 would have its barrel axis in a generally vertical position. Further, the holster folds about the strap loops 48 and 54 reducing the need for a relatively wide locker.

When the bolt 36 is retracted, the weight of the gun 28 against the interior surface of the door 16, is sufficient to immediately open the door. With the locker door 16 open and the holster is in a position shown in FIG. 4, the plane of the holster 32 is perpendicular to the plane of the door 16. Additionally, the holster is positioned so that the axis of the gun in the holster 32 is at an acute angle with the rear wall plane of the locker.

Thus, as can be seen clearly in FIG. 2, access to the gun is such that the handle thereof is in a position which could facilitate removing the gun from the holster 32. When the gun 28 is once again placed in the holster 32 and the door 16 is closed, the door will automatically return the holster to the position shown in FIG. 3.

It should be noted that the angle of the gun with respect to the rear wall 34 is determined by the length of the straps 44 and 46 which extend beyond the main points of the gun holster 32 and form the loops 48 and 52. The door hinge 40 allows the door 16 to drop until limited by the straps 44 and 46.

The choice of the gun barrel angle with respect to the locker rear wall plane would be determined by the height of the locker with respect to the wall and the height of the user. Normally this angle would vary from 30 to 60 degrees.

I claim:

1. A gun locker comprising:

a housing defining an enclosure having a rear wall and a front door secured to a front end of said housing, said door being pivotally openable and having an interior surface defining an interior surface of said enclosure when said door is in a closed position; said door when in a closed position being in a vertical plane and being permanently affixed to the housing by a horizontal hinge at a lower end of the door;

a locking mechanism engaging said door to be unlocked for access to the interior of said housing;

and a gun holster positioned in said housing, said holster having an elongated gun cavity for retaining a gun therein and a pair of end straps; said elongated gun cavity being symmetrically bisected by a plane, when said door is open said end straps lie in said elongated gun cavity plane and said cavity plane is perpendicular to the plane of said door, said elongated gun cavity plane being at an acute angle to the plane of said door when said door is closed, said holster having a front edge and a rear edge, one of said end straps being secured between the rear edge of said gun holster and the rear wall of said enclosure and the other strap end straps being secured between said front edge of said gun holster and the interior surface of said door.

2. A gun locker in accordance with claim 1 wherein said gun holster is rotatable so that a gun which is inserted in said cavity rotates from a generally vertical position when said door is closed to a position at an angle with respect to the vertical position when said door is opened.

3. A gun locker in accordance with claim 2 wherein the angle is approximately 30 to 60 degrees from the vertical position.

* * * * *